United States Patent [19]

Kelly

[11] Patent Number: 4,557,081

[45] Date of Patent: Dec. 10, 1985

[54] ROOFING STRUCTURE WITH HERMETICALLY SEALED PANELS

[76] Inventor: Thomas L. Kelly, 31 Sands St., Waterbury, Conn. 06723

[21] Appl. No.: 438,258

[22] Filed: Nov. 1, 1982

[51] Int. Cl.[4] ..... E04B 7/00

[52] U.S. Cl. ..... 52/94; 52/199; 52/406; 52/408

[58] Field of Search ..... 52/94, 95, 199, 408, 52/409, 406

[56] References Cited

U.S. PATENT DOCUMENTS 4,162,597 7/1979 Kelly ..... 52/592 X 4,223,486 9/1980 Kelly ..... 52/199 X

FOREIGN PATENT DOCUMENTS 2817703 10/1979 Fed. Rep. of Germany ..... 52/408

OTHER PUBLICATIONS

Trocal Roofing, Sales Brochure, 8-1969 Dynamit Nobel Aktiengesellschaft.

*Primary Examiner*—Carl D. Friedman

*Attorney, Agent, or Firm*—Hayes & Reinsmith

[57] ABSTRACT

A roofing structure is disclosed having a layer of blocks of insulating material supported on a roof deck and featuring a hermetic seal encapsulating a limited part of the insulating material layer and which completely envelopes selected insulation blocks covering at least portions of the deck periphery to effect wind uplift resistance.

14 Claims, 10 Drawing Figures

ROOFING STRUCTURE WITH HERMETICALLY SEALED PANELS

FIELD OF THE INVENTION

This invention generally relates to roof construction and particularly concerns a roof providing hermetically sealed panels which are uniquely resistant to wind uplift conditions which otherwise can blow up and destroy a conventional roof.

BACKGROUND OF THE INVENTION

In typical prior art roof systems, a support structure exists between a ceiling of a building and an outside roof membrane. All roof constructions are subject to what is referred to herein as "wind uplift" and which under certain high wind conditions may subject opposite interior and outside surfaces of a given roof to pressure differentials wherein wind vortexes, particularly about the roof periphery, create vacuum zones on the outside roof membrane. Under such high wind conditions, relatively positive air pressure may occur under the roof membrane by air infiltration into gaps below the membrane, when compared to existing atmospheric pressure exerted on the exterior of the roof membrane. Such positive internal pressure has been known to destructively separate the roof membrane from its support structure.

Previous efforts have been directed to solving this long-standing problem as illustrated in U.S. Pat. No. 4,005,557 to Kramer et al entitled "Suction Reduction Installation for Roofs" and which features certain roof baffling. Moreover, a variety of different insulating and sealing techniques have been utilized in the known prior art. U.S. Pat. Nos. 2,861,525, 3,307,306, 3,979,860, 4,244,151, 4,259,817 and 4,288,964 illustrate a plurality of constructions for roofs of buildings for providing insulation, fire and vapor barriers and water tight closures. However, the prior art has not been found to provide an effective solution to overcome the long known but heretofore unsolved wind uplift problem.

SUMMARY OF THE INVENTION

This invention provides unique roof panels which substantially eliminate air infiltration, which heretofore occured on the underside of a roof membrane, to thereby eliminate roof blow out by providing a roofing structure wherein peripheral panels of insulation are provided which are hermetically sealed between the ceiling and external roof membrane.

Other objects will be in part obvious and in part pointed out in more detail hereinafter.

A better understanding of the objects, advantages, features, properties and relations of this invention will be obtained from the following detailed description and accompanying drawings which set forth certain illustrative embodiments and are indicative of the various ways in which the principle of this invention is employed.

DETAILED DESCRIPTION OF PREFERRED EMBODIMENTS

Figure 1:
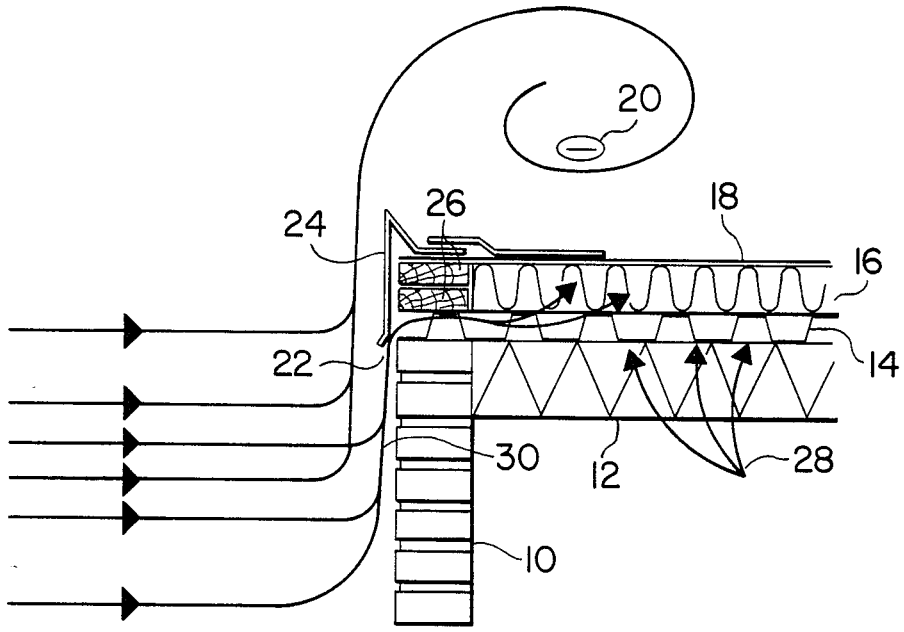
FIG. 1 is a side view, partly in section and partly broken away, showing a roofing structure constructed in accordance with existing prior art techniques.

A conventional roofing structure is illustrated in FIG. 1 wherein a vertical wall 10 is shown providing support for a steel joist 12 which underlies a steel deck 14 shown mounted on joist 12 and wall 10. Insulation 16 is supported on the steel deck 14, and a weatherproof rubber sheet or membrane 18 preferably formed of conventional ethylene propylene diene monomer or EPDM rubber material provides an exterior protective insulation cover resistant to ultraviolet or sunlight discoloration, water absorption and freezing.

In such conventional prior art construction, the atmospheric air under the roof membrane 18 is subject to expanding to equalize any pressure differential above and below the membrane 18 which is frequently created under high wind conditions. Such high wind conditions, more specifically, may result in a wind vortex above the membrane 18 causing a partial vacuum 20, particularly adjacent the roof edges and roof corners on a building due to wind updraft alongside the building which are known to be capable of physically blowing the membrane 18 off its support structure due to the positive air pressure underlying the roof membrane 18. Such positive pressure is created by air infiltration to the underside of the roof membrane 18 from otherwise open edge detail, such as the illustrated gap 22 below the gravel stop 24 and wooden edge runners 26, and from below the deck 14 whereby pressure equalization of the air within the total building and the atmospheric air surrounding the building may simply blow apart the roofing structure. This phenomenon is understood to primarily occur along the roof edge and corners where intense suction effects have been determined to be created by vortexes occurring in high winds.

Figure 10:
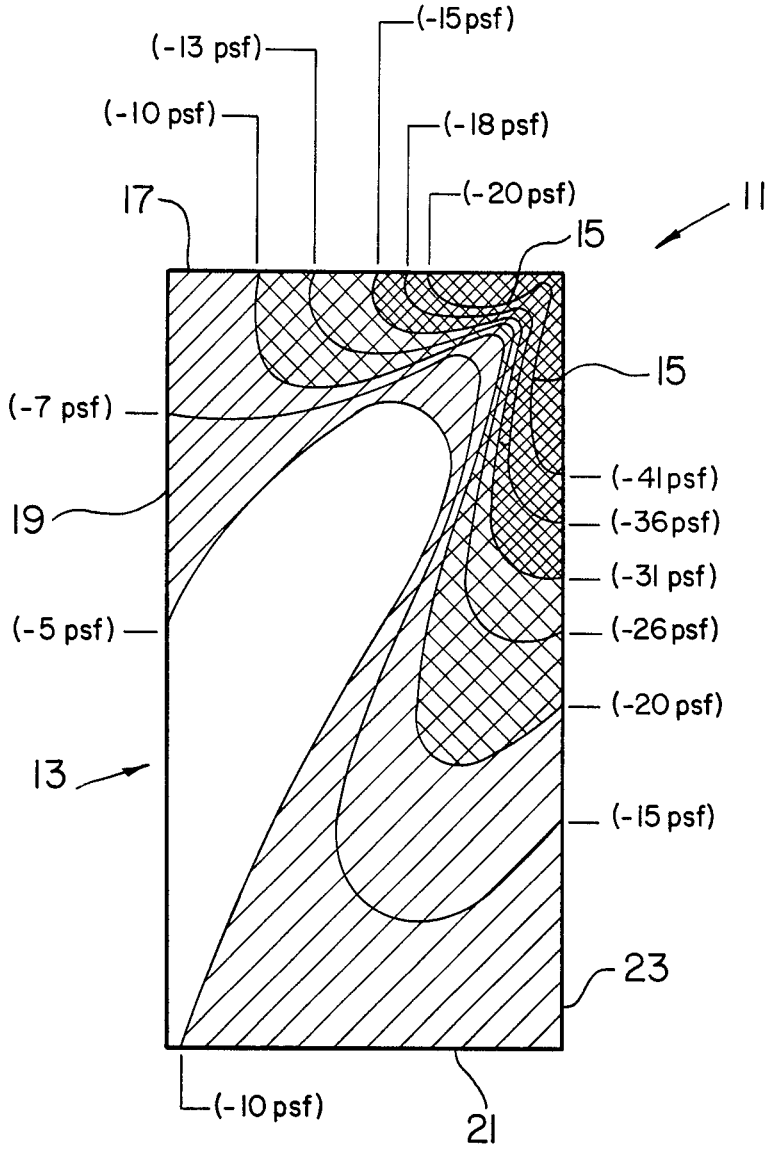
FIG. 10 is a plan view of a roof diagramatically illustrating the intensity of negative pressure zones created on the top of a roof under certain wind conditions.

For purposes of clarification, FIG. 10 shows a plan view of a building roof wherein a wind illustrated by arrow 11 is directed against building 13 and over its roof at an angle of about 45°.

The most heavily shaded roof areas depict wind uplift effects of maximum intensity while minimum intensity of uplift suction effects are shown in the lighter areas.

Under such 45° wind flow conditions directed toward a corner of a building, studies by M. Jensen and N. Frank in their work entitled "Model Scale Tests in Turbulent Wind" published in the Danish Technical Press, Copenhagen, 1965 have shown uplift suction readings of −56 pounds per square foot and −113 pounds per square foot respectively in 70 mile per hour and 100 mile per hour winds in the maximum intensity wind uplift areas bounded by line 15 near the corner of the building facing a wind flow at the depicted 45°. The intensity of wind uplift gradually decreases through various wind uplift zones as depicted by the heavy lines in FIG. 10 wherein the parenthetical data related to the heavy lines along sides 17 and 19 of the building roof perimeter identify negative uplift pressure in pounds per square foot for a 70 mph wind, and the parenthetical data pertaining to the heavy lines along sides 21 and 23 of the building roof perimeter depict uplift suction pressures in pounds per square foot for a 100 mph wind.

In further clarification of the wind uplift problem and to illustrate air infiltration into the deck from expansion of atmospheric air within the building under high wind conditions, the arrows designated 28 are shown in FIG. 1, together with arrows 30 which represent air infiltration through the deck 14 past the conventional nonhermetically sealed gravel stop 24.

Figure 2:
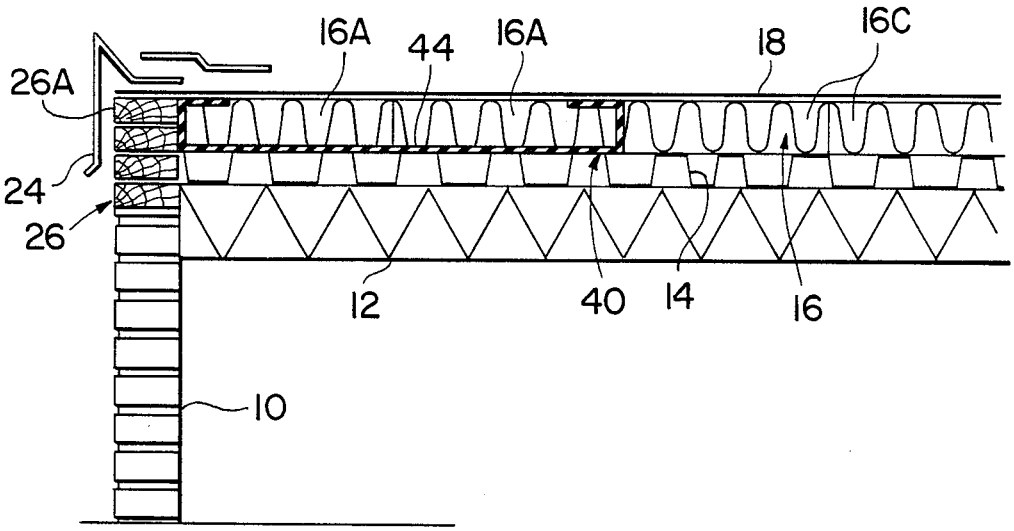
FIG. 2 is a side view, partly in section and partly broken away, showing a roofing structure constructed in accordance with this invention.

The subject invention addresses the problem of wind uplift which heretofore has been frequently encountered but not effectively solved by known conventional roofing structures. In FIG. 2, a cinder block wall 10 is illustrated which will be understood to provide support for steel joists such as at 12 which are in underlying supporting relation to a conventional metal deck 14. Wood blocking 26 is supported directly on the cinder block wall 10 and secured by means such as an anchor pin, not shown, and a gravel stop 24 is schematically illustrated (in exploded relation, for clarity) as being disposed in overlying relation to the upper wood blocking 26A at the roof edge. Supported on deck 14 are blocks of insulation generally designated 16. These blocks of insulation 16 are of generally uniform size and height but will be understood to be cut to fit during installation to ensure complete and proper roof coverage. These blocks may be formed of any suitable insulating material such as urethanes or other insulation material for providing an energy efficient covering to prevent escape of heat from the building in cold weather and undesired inflow of heat to the interior of the building in hot weather.

Figure 3:
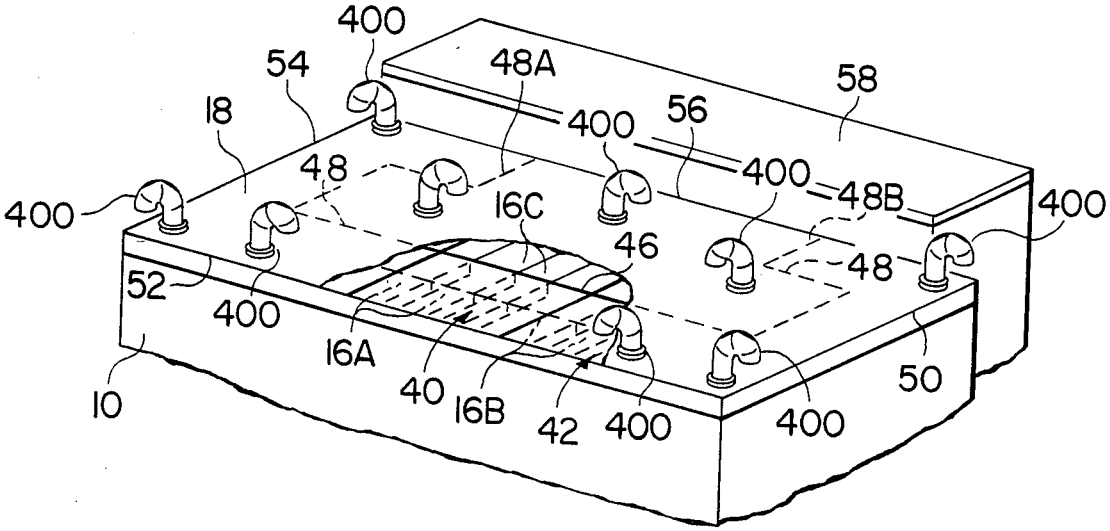
FIG. 3 is a perspective view of a roof incorporating this invention.

In accordance with one feature of this invention, at least a peripheral portion of the deck 14 (FIGS. 2 and 3) is provided with blocks such as at 16A and 16B of insulating material which are formed into air sealed or hermetically sealed insulating panels such as at 40, 42 (FIG. 3). These panels 40, 42 are hermetically sealed relative to the overlying membrane 18 (which as previously noted may be formed of EPDM rubber or functionally equivalent membrane) and to the roof edge detail of the roofing structure of this invention. Such structure positively eliminates undesired air infiltration through insulation 16 to the underside of the roof membrane 18 from inside the building, the underlying deck 14 or from updrafts along an outside wall 10 as previously noted in FIG. 1 in connection with prior art roofing structure.

In the specifically illustrated embodiment of FIGS. 2 and 3, the hermetic seal is formed of air impermeable sheeting 44 which may be of any suitable type such as polyethylene or its equivalent. Such sheeting 44 envelopes blocks 16A and 16B of the insulating material 16 covering at least a peripheral portion of the deck (the inner bounds of which are indicated by lines 46, 48) and may be positively secured, for example, by adhesive bonding, not shown, between upper partial wraps (FIG. 2) of sheeting 44 and the overlying rubber membrane 18 to form totally sealed hermetic roofing panels 40, 42. As best seen in FIG. 3, such hermetic panels 40, 42 which may respectively comprise several individual blocks of insulation such as at 16A and 16B, are arranged in abutting side-by-side relation along the entire roof perimeter which is exposed to potential wind uplift conditions of maximum magnitude. It is not believed to be necessary to completely seal the entire layer of insulation 16 since the interior roof, such as where blocks 16C are situated, which is more remote from the roof perimeter, is not normally subjected to intense vortical winds. In the specifically illustrated embodiment, the hermetic panels such as at 40, 42 extend completely over peripheral portions of the roof bounded by lines 46, 48 and by roof edges 50, 52 and 54. The panels 40, 42, however, are not shown in FIG. 3 extending completely along roof edge 56 which abuts an adjoining building structure extending substantially above roof edge 56. Rather, structure 58 itself virtually eliminates any possible sidewall updraft below an intermediate portion of roof edge 56. Any consequent need for total peripheral protection of the roof against winds is accordingly eliminated over the intermediate peripheral strip along roof edge 56 bounded by lines 48A and 48B.

If desired, abutting edges of adjacent panels 40, 42 may also be sealed against air infiltration such as by taping, particularly along bottom abutting panel edges, to further minimize air infiltration from below insulation 16 to the underside of the roof membrane 18. In certain installations, it may be desirable to secure such hermetic panels to the roof deck by fasteners which may diminish the sealing effect of the sheeting 44, but any resulting adverse effects are believed to be diminimis to the overall integrity of the hermetic panel.

Figure 4:
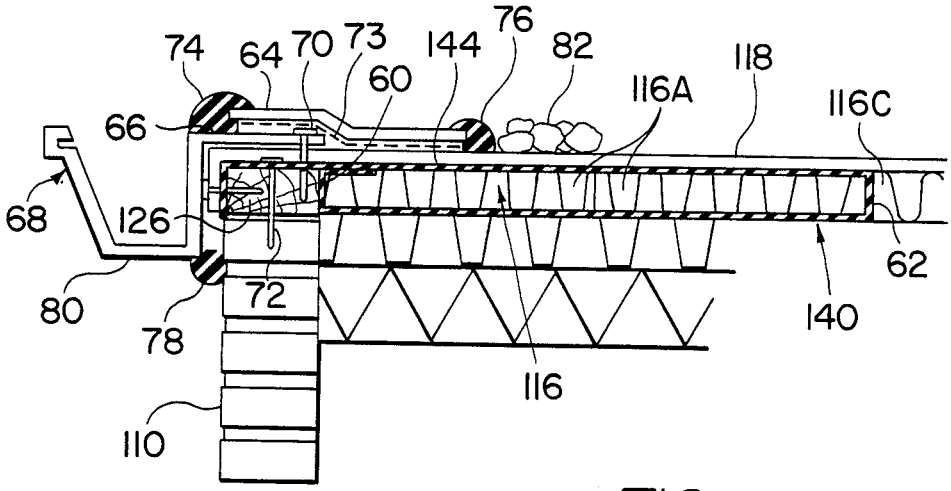
FIG. 4 is a side view, partly in section and partly broken away, of a roofing structure incorporating this invention and showing certain gutter detail.

As shown in FIG. 4, an air seal sheet 144 such as polyethylene is wrapped about each outer face of the illustrated peripheral blocks 116A of insulating material to extend downwardly from each upper edge such as at 60 and under the bottom of the blocks 116A. The air seal sheet 144 extends upwardly along an interior face 62 of blocks 116A at their juncture with adjacent interior blocks 116C and is reversely wrapped over the top surface of the peripheral insulation blocks 116A and over the upper and outside surfaces of wooden edge runner 126. A rubber sheet membrane 118 overlies the outside and upper surfaces of runner 126 and will be understood to completely cover the layer of insulation 116 including its peripheral insulating hermetic panels such as at 140. If desired, the polyethylene sheet 144 may be secured by any suitable contact adhesive which serves to fix the sheet 144 to selected areas of the enveloped insulating blocks 116A or runner 126.

An overlying rubber sheet 64 of peripheral weatherproofing membrane is shown at the edge of the roofing structure overlying rubber membrane 118 and an extension arm 66 of an outside fabricated gutter 68. The latter is fixed by suitable fasteners such as at 70 to wood runner 126 which in turn is secured by anchor pin 72 at the top of wall 110. Contact adhesive 73 secures sheet 64 to the underlying components. Paste sealant is illustrated as being applied at 74 and 76 along outer and inner longitudinally extending edges of the exposed rubber sheet 64, and a bead of sealant 78 is provided to completely seal any gap between wall 110 and base 80 of gutter 68, whereby the gutter 68 comprises an element of the disclosed roofing structure hermetic seal. In FIG. 4, gravel 82 is shown loosely laid over the upper surface of the roofing structure, and it will be understood that such gravel 82 is supported directly on the exposed upper surface of the EPDM rubber sheet membrane 118 which is in overlying relation to insulation 116.

Figure 5:
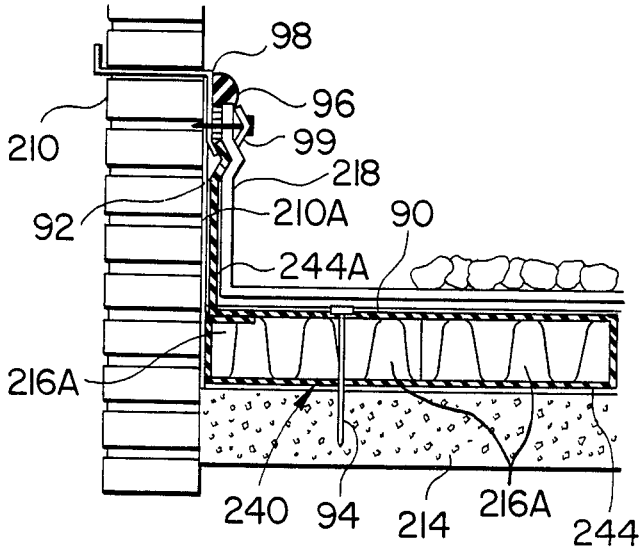
FIG. 5 is a side view, partly in section and partly broken away, of a roofing structure incorporating this invention and showing certain flashing detail.

In FIG. 5, a hermetic panel 240 with air seal sheet 244 enveloping insulation blocks 216A is shown in a wall flashing construction. As in the foregoing embodiments, the hermetic panel 240 is provided on a peripheral portion of a deck 214 and in abutment with a wall 210. If desired, mineral boards or Masonite fiberboards 90 and 92 may be laid respectively over the hermetic panel 240 and directly against the adjacent upstanding wall surface 210A. Board 90 is secured together with underlying panel 240 to deck 214 by fastener 94. Sheet 244 is continued upwardly at 244A from panel 240 and is sandwiched between board 92 and a cover sheet of rubber membrane 218. The board 92, upstanding runs of sheet 244A and membrane 218 are then secured in any suitable manner to wall 210 and sealed with paste sealent 96 to a through wall metal flashing member 98. A termination bar 99 installed in accordance with the teachings of my U.S. Pat. No. 4,335,546 issued June 22, 1982 provides a rugged fastener for securing the components in a quick and easy operation.

The embodiment of FIG. 5 is particularly useful wherein the hermetic panels of this invention are to be installed along a roof edge as described above at 56 adjacent an adjoining upstanding wall such as provided by building structure 58 in FIG. 3.

Figure 6:
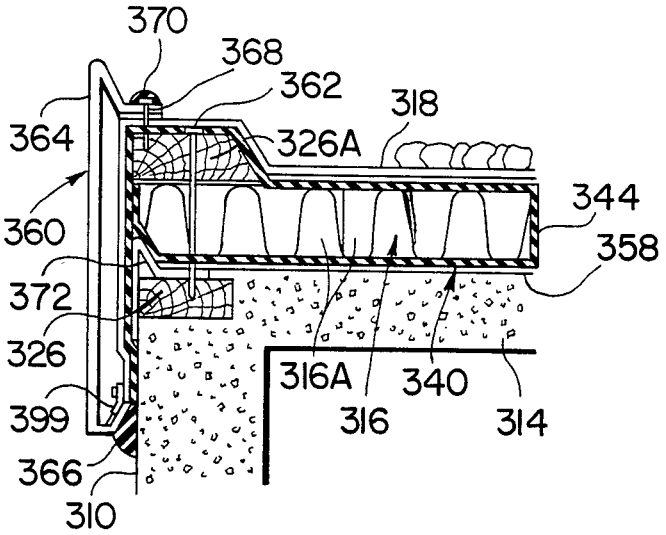
FIG. 6 is a side view, partly in section and partly broken away, of a roofing structure incorporating this invention and illustrating certain gravel stop flashing detail.

Another embodiment of this invention is illustrated in FIG. 6 wherein a deck 314 of concrete with an existing roof membrane 358 is illustrated as supporting an overlying layer of insulation 316 and wherein edge detail is provided by a gravel stop flashing 360. All outer faces of peripheral insulation blocks such as 316A are again enveloped by an hermetic seal utilizing air barrier polyethylene sheet 344 or its equivalent. Peripheral wood blocking 326 is illustrated in underlying relation to panel 340 along the edge of wall 310. A second wood blocking 326A is shown along an edge of the roofing structure in overlying relation to peripheral edges of insulation blocks 316A. A fastener 362 is provided for securing the wood blocking 326, 326A and interposed peripheral block 316A of insulation relative to wall 310. The air barrier polyethylene sheet 344 is wrapped about the peripheral blocks 316A and over the upper wood blocking 326A and then is draped downwardly along an outside face of the roof and underlying wall 310. Sheet 344 is covered by an overlying wrap of EPDM rubber sheet membrane 318 which extends upwardly along the face of wall 310 and side edge of the roof and inwardly toward the interior of the roof in overlying relation to the air seal sheet 344 covering upper wood blocking 326A and the peripheral insulation blocks 316A. It is to be understood that, as in the previous embodiments, the loosely laid weather resistant waterproof rubber sheet membrane 318 preferably extends completely over the insulation 316 and is in direct contact engagement with those blocks (not shown) on the interior of the peripheral hermetic panels 340. Membrane 318 may be spot bonded directly to such interior insulation blocks. For those insulation blocks which will not accept adhesive, reference is made to my U.S. Pat. No. 4,162,597, the subject matter of which is incorporated herein by reference, wherein a facile spot bonding technique is fully described to provide a partially adhered membrane.

In FIG. 6, gravel stop flashing 360 is fixed to an upper terminal edge of the illustrated roofing structure to project angularly upwardly beyond the roof edge and then vertically downwardly, providing a metal roofing trim face 364, and then is reversely turned inwardly to wall 310 where the flashing is secured by suitable means such as my previously referenced termination bar 399. Paste sealant bead 366 provides an effective seal between flashing 360 and wall 310, and fastener 368 at the top of the gravel stop flashing 360 is preferably sealed with a suitable paste sealant 370. Flashing 360 accordingly serves to seal rubber membrane 318 and underlying air barrier sheet 344, both of which cover the face of wall 310. In the specifically illustrated embodiment, the roofing components incorporating the described peripheral hermetically sealed insulating material is shown directly mounted on a preexisting gravel stop 372 and the preexisting roof membrane 358 which is in overlying relation to the concrete deck 314 to thereby effectively provide a built up roof construction wherein the perimeter encapsulated panels 340 are effectively sealed against undesired air infiltration below weatherproof rubber membrane 318. As in the previously described embodiments of FIGS. 2, 3 and 4, the hermetic seal of this invention is particularly useful for installation along roof edges having an underlying wall structure subject to wind updraft.

Figure 7:
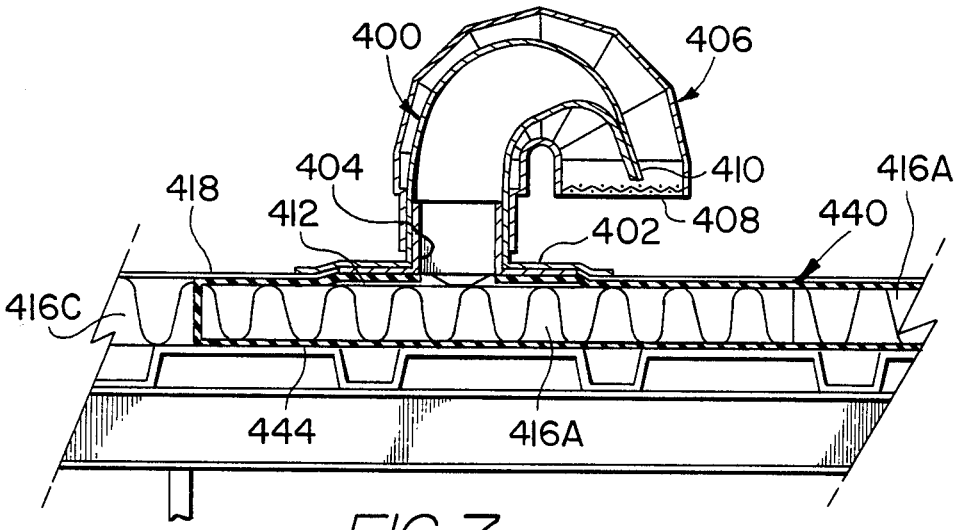
FIG. 7 is a side view, partly in section and partly broken away, illustrating certain features of an equalizer valve used in this invention.

In accordance with another feature of this invention, undesired vacuum uplift which is so destructive of known roofing structures is further prevented by the provision of one-way venting means communicating with the inner confines of the disclosed hermetically sealed peripheral panels for exhausting air under its membrane sheet to atmosphere. More specifically, a one-way duckbill valve 400 (FIG. 7) extends upwardly from a flared annular collar 402 about a base support 404 and is supported within an upstanding curved vent stack 406 which is fixed to the base support 404. Vent stack 406 has an outlet end 408 adjacent an outlet end 410 of valve 400, both of which face downwardly toward the upper roof surface. Valve 400 communicates with the base support 404 which, in turn, is shown in FIG. 7 as communicating with a space 412 between the insulation blocks 416A and air barrier sheet 444 of the hermetic seal panel 440 formed of the peripheral blocks of insulation as described above and which are adjacent an interior unsealed insulation block such as shown at 416C. With the outlet end 410 of valve 400 and the vent stack 406 facing downwardly at its outlet 408 toward the upper roof surface, air exhausted from the interior of the peripheral hermetically sealed insulating block panels, such as at 440, is positively directed toward membrane 418. The illustrated valve 400 is of a type fully described in my U.S. Pat. No. 4,223,486 issued Sept. 23, 1980 and entitled "Roof Equalizer", the subject matter of which is incorporated herein by reference.

In accordance with this invention, such one-way venting means 400 is preferably provided adjacent corners of the deck and in spaced apart relation along the periphery as best seen in FIG. 3. In addition, the venting means 400 may also be provided on the interior of the disclosed roofing structure wherein each valve is spaced apart relative to other similar valves, each of which are provided for exhausting air from spaces, such as at 412 in FIG. 7, between the loosely laid rubber membrane sheet and underlying insulation material of the roofing structure. As will be appreciated by those skilled in the art, the spacing and positioning of the venting means 400 will vary depending on different factors, the specific roof construction, its location relative to prevailing winds, adjoining or adjacent buildings and the like.

Such one-way venting means 400 effectively provides air exhaust from under the loosely laid membrane sheet to atmosphere particularly under potentially dangerous high wind uplift conditions, and the specifically illustrated embodiment of the one-way venting means 400 discharges the air so exhausted onto the roof underlying the outlet end 410 of the valve. Such action not only equalizes any undesired pressure differential between the atmospheric air within the building and any reduced air pressure above the roof which may be caused by wind vortex, but the air exhausted from the space underlying the rubber membrane such as at 418 causes the outlet end 410 of the valve to open and discharge such positive pressurized air into potential vacuum pressure zones on top of the roof to provide a counteracting force thereto, tending to drive the rubber sheet membrane 418 downwardly against the blocks of insulating material or insulating hermetic panel 440.

Figure 8:
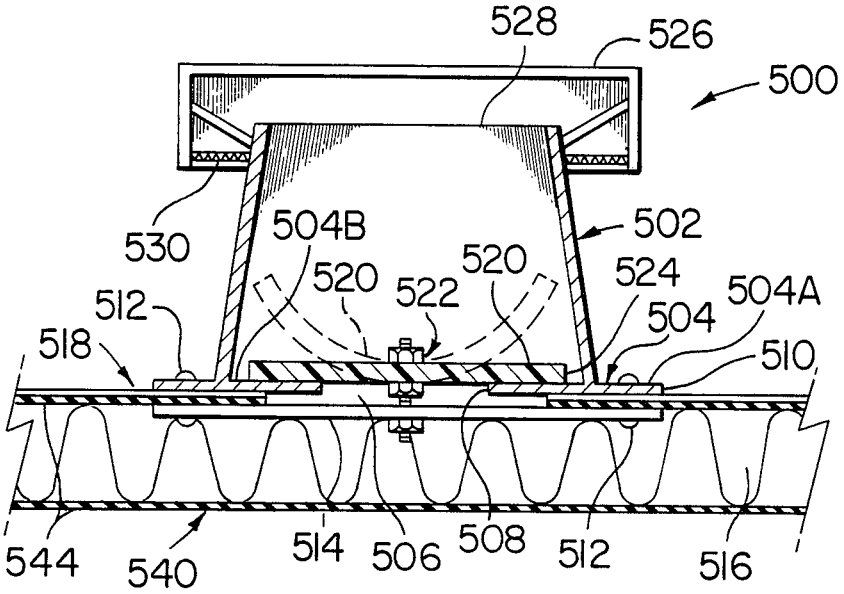
FIG. 8 is a side view, partly in section and partly broken away, showing another embodiment of an equalizer valve used in this invention.
Figure 9:
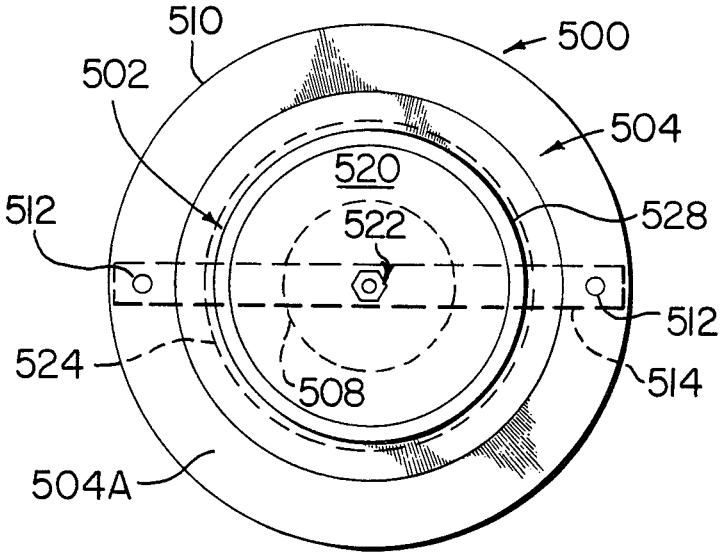
FIG. 9 is a plan view of the valve of FIG. 8 with its cover removed.

Another embodiment of a one-way venting means is illustrated in FIGS. 8 and 9 wherein a vent 500 with a base 502 having an annular collar 504 is shown extending upwardly from the loosely laid membrane 518 and communicating with a space 506 between the membrane 518 and the insulating material 516 within hermetic seal sheet 544. Vent 500 features a one-way diaphragm type valve having a base 502 shown with a cross-sectional truncated cone shape. Base 502 is integrally secured intermediate inner and outer edges 508 and 510 of the collar 504. An outer collar rim portion 504A outside the confines of the base 502 is secured such as by rivets 512 or other fasteners to an underlying cross bar 514 extending diametrically across the bottom of base 502 of the vent 500. The membrane 518 and hermetic seal sheet 544 are preferably adhesively secured to one another and to the bottom of the collar 504 and are shown clamped between collars 504 and cross bar 514. A flexible circular flap valve 520 of any suitable material such as an elastomeric sheet or sheet silicone is fixed at its center to the cross bar 514 by a fastener 522. The outer periphery 524 of the circular flap 520 under normal illustrated atmospheric conditions rests on and is supported in a self-sealing manner by an inner collar rim portion 504B within the confines of the vent base 502. An upper cover 526 is fixed in overlying relation to an open upper outlet end 528 of the vent base 502 which preferably is additionally protected against entry of undesirable objects into its open end 528 by suitable screening 530.

Accordingly, vent 500 provides for exhausting air from spaces, such at as at 506 in FIG. 8, between the membrane 518 and underlying hermetically sealed insulation 516 upon a differential in air pressure on opposite sides of the membrane 518 effected by the above described wind uplift conditions whereupon the one-way flap valve 520 cups open about its central fastener 522 into a broken line position to permit air exhaust from the interior of hermetically sealed insulating block panels 540. Vents such as at 500 are preferably located as described in connection with the embodiment of FIG. 7.

All protrusions on the disclosed wind uplift resistant roofing structure of this invention, such as the disclosed vents 400, 500, drains and similar protrusions, preferably are flashed to provide a hermetically sealed construction of high integrity.

It will be seen from the foregoing disclosure that the hermetic seal completely envelopes the blocks of the insulating material covering at least peripheral portions of the deck of the roofing structure to provide an effective air seal against undesired infiltration of air to the underside of the rubber sheet membrane. The disclosed hermetic seal of this invention features the continuous encapsulation of perimeter panels, particularly by gas impermeable sheeting which may also be combined with an underlying deck which in itself may be impermeable to air infiltration. The hermetic seal additionally may include a sealed imperforate wall flashing or sealed imperforate gutter, as well as a sealed imperforate gravel stop where such particular edge detail is being utilized. Such construction is in direct contrast to common industry practice of providing vented perimeter roof edges. All roof edges of the disclosed embodiments which are subject to updrafts, as distinct from the roof edge 56 between lines 48A and 48B (FIG. 3), are preferably covered by the hermetically sealed panels of this invention which may extend, say, from about ten to twenty feet inwardly from the roof edge, depending upon the direction the roof edge faces and the prevailing wind conditions in the area. Moreover, the disclosed hermetic seal enveloping peripheral blocks of the insulation material is particularly useful on flat roof building structures to prevent roof tear-off or lift-off and may be utilized in cooperation with the disclosed one-way venting means of the referenced pressure equalizing valves to further minimize any undesired pressure differential on opposite sides of the rubber sheet membrane.

Finally, it will be noted that the sealed drum effect along at least portions of the roof periphery achieved by the disclosed perimeter hermetic panels effectively provides the desired air control to prevent roof lift-off in both new building construction as well as in re-roofing applications by preventing air infiltration and air expansion within the perimeter blocks of insulation.

As will be apparent to persons skilled in the art, various modifications, adaptations and variations of the foregoing specific disclosure can be made without departing from the teaching of this invention.

I claim:

1. For use in roofing installations providing resistance to wind uplift conditions, a roofing structure comprising a deck, insulating materials supported on the deck and including a multiplicity of individual insulation blocks disposed in overlying relation to the deck, sheet means enveloping a plurality of said individual insulation blocks which blocks overlie a portion of the deck, said sheet means defining a panel encapsulating a plurality of individual insulation blocks, said structure further including a plurality of such encapsulating panels which collectively form a wind uplift resistant section of the deck.

2. The wind uplift resistant roofing structure of claim 1 wherein the sheet means comprises gas impermeable sheet means.

3. The wind uplift resistant roofing structure of claim 1 wherein the sheet means comprises a weather resistant membrane loosely laid as a cover in overlying relation to insulating material and a gas impermeable sheet bonded to the weather resistant membrane and cooperating therewith to envelope said plurality of individual insulation blocks in an encapsulating panel.

4. The wind uplift resistant roofing structure of claim 3 further including one-way venting means in communication with a space below the membrane for exhausting air thereunder to atmosphere under wind uplift conditions.

5. The wind uplift resistant roofing structure of claim 4 wherein the one-way venting means comprises a base and a valve mounted therein, the base extending upwardly from the membrane and communicating with a space between the membrane and the insulating material.

6. The wind uplift resistant roofing structure of claim 4 wherein the one-way venting means comprises a plurality of one-way valves spaced apart from one another for exhausting air under the membrane to atmosphere, one of said valves being provided adjacent each corner of the deck.

7. The wind uplift resistant roofing structure of claim 1 or 4 wherein the deck includes roof edges subject to wind updraft along an underlying wall, and wherein the insulating material overlying the deck periphery adjacent said roof edges subject to wind updraft are enveloped by said sheet means.

8. The wind uplift resistant roofing structure of claim 3 or 4 wherein the membrane is fixed by spot bonding means to insulation blocks not enveloped by said sheet means to provide a partially adhered membrane.

9. The wind uplift resistant roofing structure of claim 1 or 4 including a gravel stop along at least a portion of the deck perimeter, and sealant between said gravel stop and weather resistant membrane along the deck perimeter providing a hermetic seal.

10. The wind uplift resistant roofing structure of claim 1 or 4 including a gutter along at least a portion of the deck perimeter, and sealant between the gutter and weather resistant membrane along the deck perimeter providing a hermetic seal.

11. The roofing structure of claim 1 or 4 including flashing along at least a portion of the deck perimeter, and sealant between said flashing and weather resistant membrane along the deck perimeter providing a hermetic seal.

12. The wind uplift resistant roofing structure of claim 1 wherein said individual insulation blocks are laid in a side-by-side abutting arrangement.

13. The wind uplift resistant structure of claim 1 wherein the encapsulating panels are each dimensioned and configured and disposed in a row along the outer edges of the roof structure to provide a uniform outer wind resistant configuration.

14. The wind uplift resistant roofing structure of claim 1 wherein the encapsulating panels cover at least portions of the deck periphery extending not more than about 20 feet inwardly from its perimeter.

* * * * *